US009169992B2

(12) United States Patent
Wang He

(10) Patent No.: US 9,169,992 B2
(45) Date of Patent: Oct. 27, 2015

(54) LENS AND LIGHT SOURCE MODULE INCORPORATING THE SAME

(71) Applicant: HON HAI PRECISION INDUSTRY CO., LTD., New Taipei (TW)

(72) Inventor: Li-Ying Wang He, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/050,369

(22) Filed: Oct. 10, 2013

(65) Prior Publication Data

US 2014/0177234 A1 Jun. 26, 2014

(30) Foreign Application Priority Data

Dec. 24, 2012 (TW) ..... 101149447 A

(51) Int. Cl.
*F21V 5/00* (2015.01)
*F21V 5/04* (2006.01)
*F21Y 101/02* (2006.01)

(52) U.S. Cl.
CPC . *F21V 5/048* (2013.01); *F21V 5/04* (2013.01); *F21Y 2101/02* (2013.01)

(58) Field of Classification Search
CPC ..... F21V 5/045; F21V 5/048
USPC ..... 362/336, 335, 326, 338, 311.02
See application file for complete search history.

(56) References Cited

U.S. PATENT DOCUMENTS

| | | | | |
|---|---|---|---|---|
| 7,483,220 | B2 * | 1/2009 | Kittelmann et al. | 359/742 |
| 7,837,349 | B2 * | 11/2010 | Chinniah et al. | 362/244 |
| D642,141 | S * | 7/2011 | Kuwaharada et al. | D13/180 |
| 8,038,319 | B2 * | 10/2011 | Bailey | 362/245 |
| 8,246,216 | B2 * | 8/2012 | Jiang et al. | 362/308 |
| 8,967,833 | B2 * | 3/2015 | Wang et al. | 362/311.02 |
| 2006/0120085 | A1 * | 6/2006 | Hsieh et al. | 362/338 |
| 2007/0258247 | A1 * | 11/2007 | Park et al. | 362/326 |
| 2011/0096553 | A1 * | 4/2011 | Shimokawa | 362/311.02 |
| 2011/0280023 | A1 * | 11/2011 | Lee et al. | 362/338 |

* cited by examiner

*Primary Examiner* — Jong-Suk (James) Lee
*Assistant Examiner* — Bryon T Gyllstrom
(74) *Attorney, Agent, or Firm* — Novak Druce Connolly Bove + Quigg LLP

(57) ABSTRACT

A lens includes a light incident face, a light exit face opposite to the light incident face and a plurality of micro dot patterns formed on the light exit face. The light incident face is a concave face and the light exit face is a convex face. The plurality of micro dot patterns are positioned at a central portion of the light exit face. A light source module incorporating the lens is also provided. The light source module includes a light emitting diode emitting light into the lens through the light incident face. The micro dot patterns direct the light from the light emitting diode and through the central portion of the light exit face toward a peripheral side of the lens.

12 Claims, 4 Drawing Sheets

LENS AND LIGHT SOURCE MODULE INCORPORATING THE SAME

TECHNICAL FIELD

The present disclosure relates generally to a lens and a light source module incorporating the lens, wherein the light source module has an improved uniform light distribution.

DESCRIPTION OF RELATED ART

LEDs are solid state light emitting devices formed of semiconductors, which are more stable and reliable than other conventional light sources such as incandescent bulbs. Thus, LEDs are being widely used in various fields such as numeral/character displaying elements, signal lights, light sources for lighting and display devices.

Nowadays, LED light sources are widely applied for illumination, such as being used in the backlight. A traditional light source module includes an LED light source and a lens coupled to the LED light source. However, a light distribution of the traditional light source module is mostly concentrated at an optical axis (i.e., a center) of the lens while becomes gradually weaker towards a periphery thereof. Therefore, such a lens and a light source module using the lens are difficult to satisfy the requirements of uniform light distribution.

What is needed therefore is a lens and a light source module incorporating the lens which can overcome the above mentioned limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the views.

DETAILED DESCRIPTION

Figure 1:
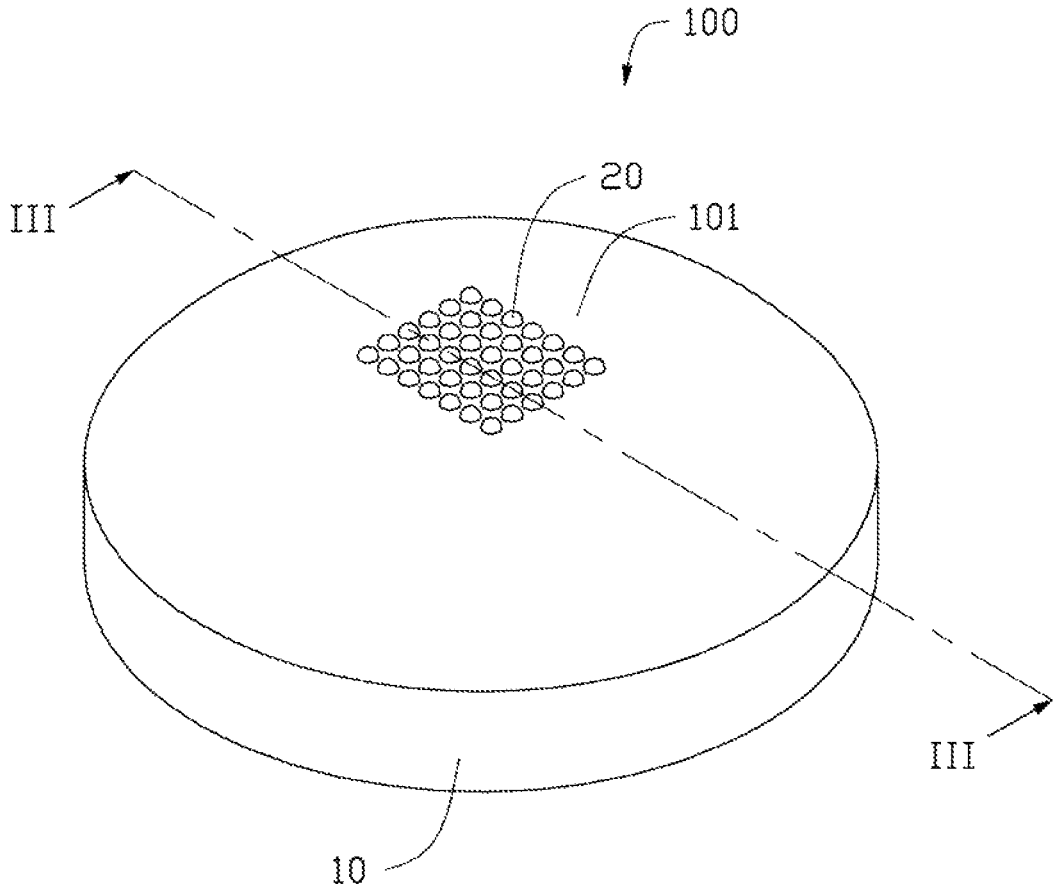
FIG. 1 is a perspective view of a light source module in accordance with a first embodiment of the present disclosure.
Figure 2:
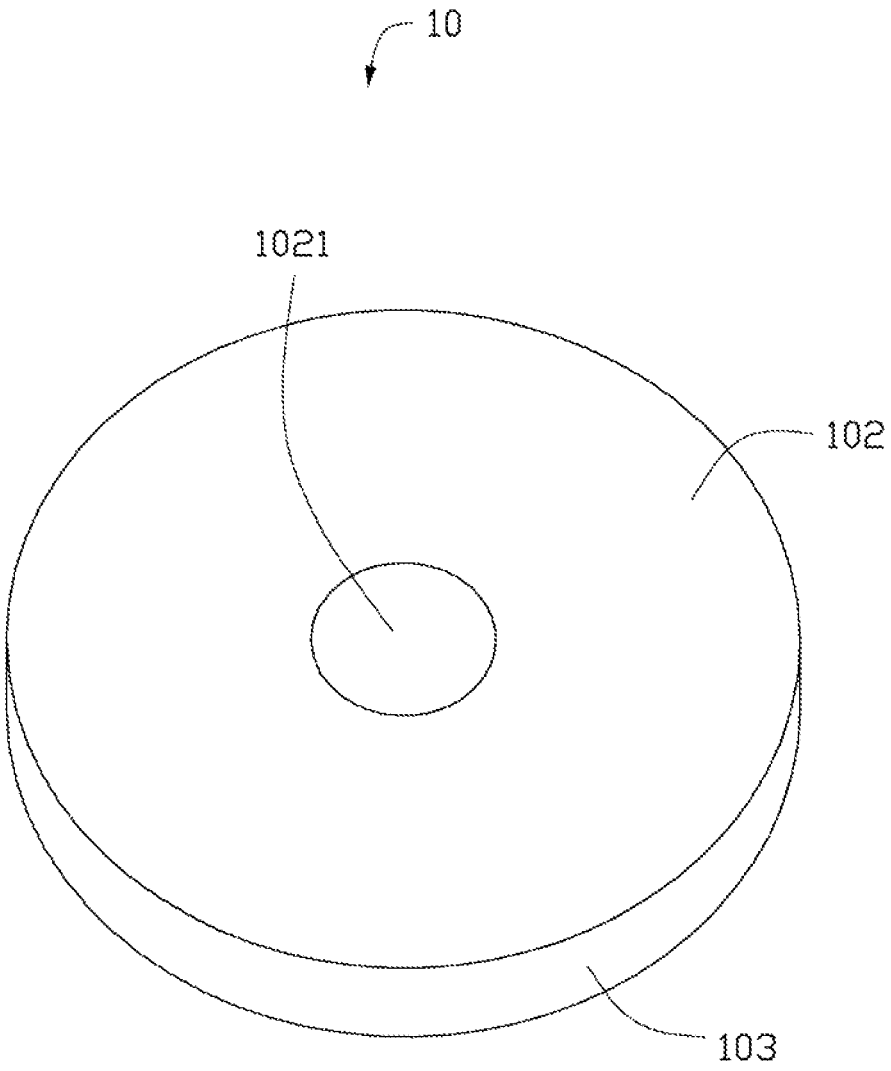
FIG. 2 is an inverted view of a lens of the light source module of FIG. 1.
Figure 3:
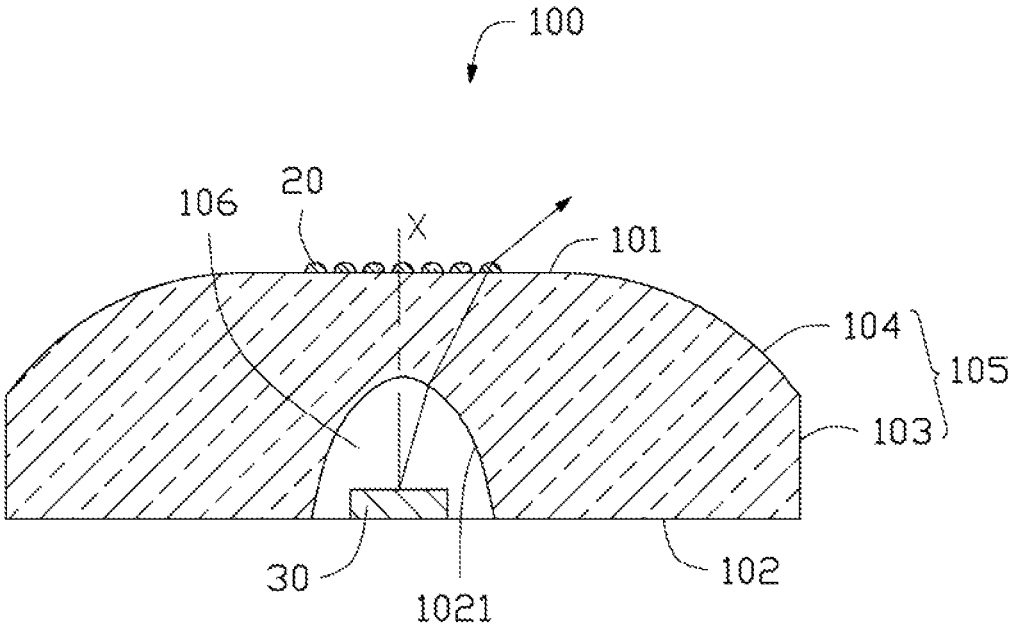
FIG. 3 is a cross-sectional view of the light source module of FIG. 1, taken along a line III-III thereof.

Referring to FIGS. 1, 2 and 3, a light source module 100 in accordance with a first embodiment of the present disclosure includes a light emitting diode (LED) light source 30 and a lens 10 coupled to the LED light source 30. The lens 10 includes a light incident face 1021, a light exit face 105 opposite to the light incident face 1021 and a plurality of micro dot patterns 20 arranged on a central portion 101 of the light exit face 105 to scatter light concentrated near an optical axis X of the lens 10. The light incident face 1021 is radially symmetrical relative to the optical axis X of the lens 10. The light exit face 105 is also radially symmetrical relative to the optical axis X of the lens 10.

In the present embodiment, the light incident face 1021 is a concave face and the light exit face 105 is a convex face. The light incident face 1021 is a paraboloid in shape. The central portion 101 of the light exit face 105 is flat. Alternatively, the light incident face 1021 is an ellipsoid in shape, and the central portion 101 of the light exit face 105 projects outwardly.

The lens 10 further includes an annular connecting face 102. The connecting face 102 interconnects the light incident face 1021 and the light exit face 105. The light incident face 1021 is located at a center of the connecting face 102. The light incident face 1021 is recessed inwardly from an inner periphery of the connecting face 102 toward the light exit face 105. The light incident face 1021 and the connecting face 102 cooperatively define a receiving space 106 for receiving the LED light source 30 therein.

The light exit face 105 includes a secondary light exit face 103 and a primary light exit face 104. The secondary light exit face 103 extends upwardly from an outer periphery of the connecting face 102. The secondary light exit face 103 is cylindrical. The primary light exit face 104 bends inwardly and upwardly from a top periphery of the secondary light exit face 103. The central portion 101 of the light exit face 105 is located at a center of the primary light exit face 104.

The LED light source 30 is received in the receiving space 106 and faces the light incident face 1021 of the lens 10. The LED light source 30 is located at the optical axis X of the lens 10. That is to say, an optical axis of the LED light source 30 coincides with the optical axis X of the lens 10.

Light emitted from the LED light source 30 which is refracted into the lens 10 through the light incident face 1021 is mostly refracted out of the lens 10 through the primary light exit face 104, with the remaining portion of light refracting out of the lens 10 through the secondary light exit face 103.

The lens 10 is made of transparent or translucent material such as glass, polycarbonate, for transmission of the light rays emitted from the LED light source 30. The micro dot patterns 20 are formed on the primary light exit face 104 of the light exit face 105 by screen printing processes, photolithographic processes, dry-etch mask or like.

The plurality of micro dot patterns 20 are compactly arranged in a square matrix on the central portion 101 of the light exit face 105. Each micro dot pattern 20 is hemispherical. The micro dot patterns 20 are spaced from each other. Alternatively, each micro dot pattern 20 is pyramid shaped, and the plurality of micro dot patterns 20 are arranged in a series of concentric circles, and the concentric circles are spaced from each other to leave a gap (not shown) therebetween. A portion of light directly passes through the gap to propagate in the forward direction of the light source module 100.

In the present disclosure, the plurality of micro dot patterns 20 are arranged on the central portion 101 of the light exit face 105 to scatter light rays concentrated near the optical axis X of the lens 10; thus the light source module 100 having a uniform light distribution is obtained.

Figure 4:
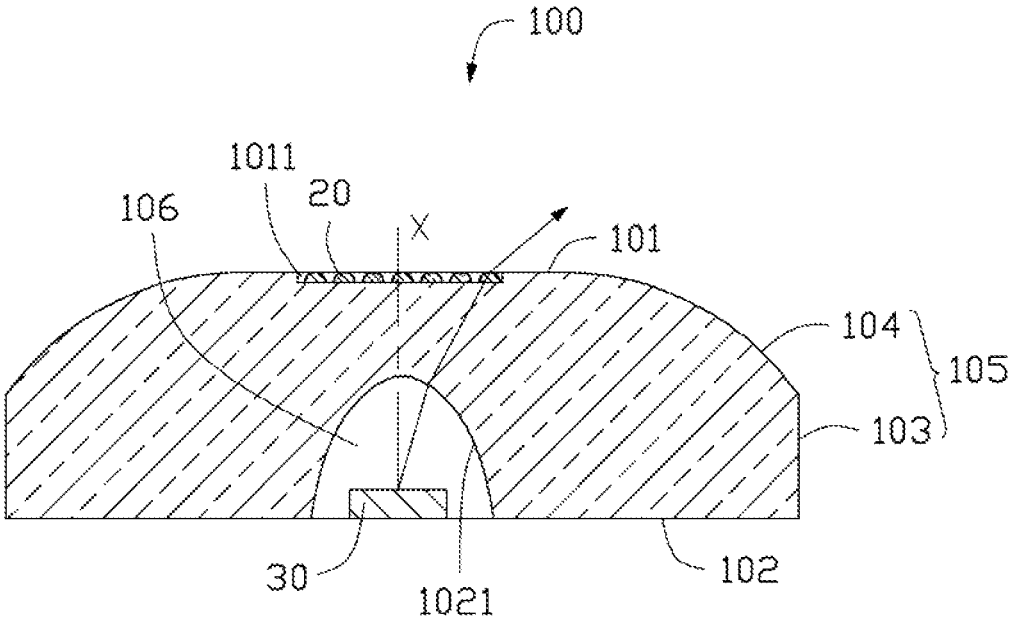
FIG. 4 is a schematic, cross-sectional view of a light source module in accordance with a second embodiment of the present disclosure.

Referring to FIG. 4, different from the light source module 100 shown in FIG. 1, the central portion 101 of the light exit face 105 of the light source module 100 is recessed inwardly toward the light incident face 1021 to define a recess 1011 for receiving the plurality of micro dot patterns 20 therein according to a second embodiment of the present disclosure. The recess 1011 has a depth equal to the thickness of the micro dot patterns 20 so as to expose the top of each micro dot pattern 20 therein. It is preferred that central portion 101 of the light exit face 105 is initially wet etched or machined to form the recess 1011 having a predetermined depth equal to a thickness of each micro dot pattern 20. The micro dot patterns 20 are then formed in the recess 1011. It is to be understood that the shape and depth of the recess 1011 could change according to the actual requirements of light distribution.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A lens comprising:

a light incident face configured for receiving light from a light emitting diode light source;

a light exit face opposite to the light incident face; and a plurality of micro dot patterns arranged on the light exit face;

wherein the light incident face is a concave face and the light exit face is a convex face, and the plurality of micro dot patterns are formed on a central portion of the light exit face;

wherein the light emitting diode light source is located at an optical axis of the lens, the optical axis penetrates through the light incident face and the light exit face, and both of the light incident face and the light exit face are radially symmetrical relative to the optical axis;

wherein the lens further comprises an annular connecting face interconnecting the light incident face and the light exit face, and the exit face comprises a secondary light exit face extending upwardly from an outer periphery of the annular supporting face and a primary light exit face curving inwardly and upwardly towards the optical axis of the lens from a top periphery of the secondary light exit face;

wherein the topmost point of the light incident face is higher than the top peripheral edge of the secondary light exit face; and wherein the central portion of the light exit face is recessed inwardly toward the light incident face to define a recess, the plurality of micro dot patterns are received in the recess, and the recess has a depth equal to a thickness of the micro dot patterns.

2. The lens of claim 1, wherein a portion of the light exit face is flat.

3. The lens of claim 1, wherein each micro dot pattern is hemispherical.

4. The lens of claim 3, wherein the micro dot patterns are spaced from each other.

5. The lens of claim 3, wherein the plurality of micro dot patterns are arranged in a series of concentric circles or a matrix on the central portion of the light exit face.

6. The lens of claim 1, wherein the light incident face is located at a center of the annular supporting face and recessed inwardly from an inner periphery of the annular supporting face toward the light exit face.

7. A light source module comprising:

a lens and an LED light source coupled to the lens;

the lens comprising a light incident face, a light exit face opposite to the light incident face and a plurality of micro dot patterns formed on the light exit face;

wherein the light incident face is a concave face and the light exit face is a convex face, and the plurality of micro dot patterns are positioned at a central portion of the light exit face;

wherein the LED light source faces toward the light incident face of the lens;

wherein the light emitting diode light source is located at an optical axis of the lens, the optical axis penetrates through the light incident face and the light exit face, and both of the light incident face and the light exit face are radially symmetrical relative to the optical axis;

wherein the lens further comprises an annular connecting face interconnecting the light incident face and the light exit face, and the exit face comprises a secondary light exit face extending upwardly from an outer periphery of the annular supporting face and a primary light exit face curving inwardly and upwardly towards the optical axis of the lens from a top periphery of the secondary light exit face;

wherein the topmost point of the light incident face is higher than the top peripheral edge of the secondary light exit face; and wherein the central portion of the light exit face is recessed inwardly toward the light incident face to define a recess, the plurality of micro dot patterns are received in the recess, and the recess has a depth equal to a thickness of the micro dot patterns.

8. The light source module of claim 7, wherein a portion of the light exit face is flat.

9. The light source module of claim 7, wherein each micro dot pattern is hemispherical or pyramid-shaped.

10. The light source module of claim 9, wherein the plurality of micro dot patterns are arranged in a series of concentric circles or a matrix on the central portion of the light exit face.

11. The light source module of claim 7, wherein the plurality of micro dot patterns are only arranged on the central portion of the light exit face to scatter light rays which are emitted from the LED light source and concentrated near the optical axis of the lens.

12. The lens of claim 1, wherein the plurality of micro dot patterns are only arranged on the central portion of the light exit face to scatter light rays which are emitted from the light emitting diode light source and concentrated near the optical axis of the lens.

* * * * *